United States Patent [19]

Oyama

[11] 4,203,207

[45] May 20, 1980

[54] APPARATUS FOR AUTOMATICALLY APPLYING TOP END STOPS TO A SLIDE FASTENER CHAIN

[75] Inventor: Yoshio Oyama, Asahi, Japan

[73] Assignee: Yoshida Kogyo K.K., Tokyo, Japan

[21] Appl. No.: 946,547

[22] Filed: Sep. 28, 1978

[30] Foreign Application Priority Data

Oct. 6, 1977 [JP] Japan ..... 52-120295

[51] Int. Cl.[2] ..... B21D 53/52

[52] U.S. Cl. ..... 29/767

[58] Field of Search ..... 29/33.2, 408, 409, 766, 29/767, 768

[56] References Cited

U.S. PATENT DOCUMENTS

| | | | |
|---|---|---|---|
| 3,127,670 | 4/1964 | Bruning | 29/408 |
| 3,340,594 | 9/1967 | Frohlich et al. | 29/768 X |
| 3,689,980 | 9/1972 | Oyama | 29/408 |
| 3,863,321 | 2/1975 | Perlman | 29/408 |
| 3,872,571 | 3/1975 | Douri | 29/408 |

*Primary Examiner*—Ervin M. Combs

*Attorney, Agent, or Firm*—Bucknam and Archer

[57] ABSTRACT

Apparatus for applying top end stops to a continuous fastener chain is provided with camming means for taking a pressure roller into and out of engagement with its associated feed or drive roller at respective time points coincidental with the supplying of top end stops to the fastener chain and with the completion of clamping the end stops onto the fastener chain.

4 Claims, 9 Drawing Figures

APPARATUS FOR AUTOMATICALLY APPLYING TOP END STOPS TO A SLIDE FASTENER CHAIN

BACKGROUND OF THE INVENTION

1. Field of the Invention

This invention relates to an apparatus for automatically applying top end stops to a slide fastener chain.

2. Prior Art

In the manufacture of slide fasteners, it is the conventional practice to provide a fastener chain consisting of a pair of stringer tapes each having spaced groups of interlocking fastener elements along the inner edges thereof with the opposed fastener elements on the respective tapes interengaged. Each group of the fastener elements is spaced from adjacent groups by a blank tape portion devoid of any fastener element. Each group designates the length of an individual fastener to be produced. Before the chain is cut at the blank portions to provide individual fasteners, it is desirable to subject the chain to various fastener assembling operations such as mounting of top and bottom end stops and sliders.

The present inventor has proposed a method and apparatus for applying top end stops to a slide fastener chain while the latter is being advanced in a continuous flow, as disclosed in U.S. Pat. No. 3,689,980. While this prior-art apparatus has many advantages including mounting of top end stops on a fastener chain at increased rate of speed, it has encountered with a difficulty in that since the mounting of top end stops is effected with the feed roller held in intimate engagement with its associated pressure roller, the leading fastener element on either of two opposed stringer tapes is prone to receive excess or greater pressure in abutting engagement with a top stop clamping means than the leading fastener element on the other stringer tape due to the fact that either of the two opposed leading elements is positioned normally one element pitch or sometimes even longer distance out of registration with the other. This would result in misaligned fastener elements. In order to eliminate such difficulty, the various operating parts of the apparatus have been required to be adjusted in their operation timing, involving highly skilled manipulation and considerable time consumption.

SUMMARY OF THE INVENTION

With the foregoing difficulties of the prior-art apparatus in view, the present invention has for its object to provide an improved apparatus which will accomplish the mounting and clamping of top end stops onto a slide fastener chain at proper positions closely adjoining the leading fastener elements without imposing objectionable pressure on the fastener elements.

The above and other objects and features of the present invention will become more readily apparent from the following description of a preferred embodiment of the invention, reference being had to the accompanying drawings wherein like numerals refer to like parts.

DETAILED DESCRIPTION OF THE PREFERRED EMBODIMENT

Figure 1:
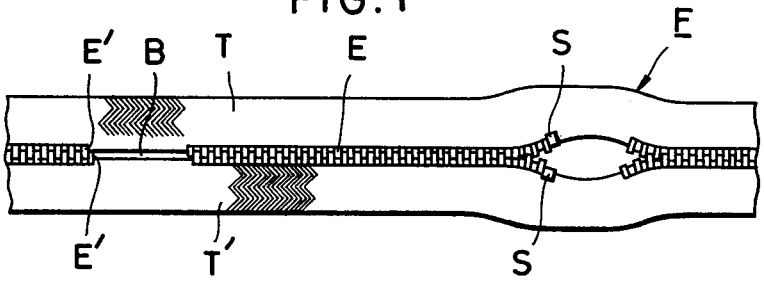
FIG. 1 is a fragmentary plan view of an exemplary fastener chain having top end stops mounted in position according to the invention.

Referring now to the drawings, and first to FIG. 1, the fastener chain F has a pair of stringer tapes T, T' having attached along the inner edges thereof groups of interlocking elements E. The fastener elements E are arranged in groups along the length of the respective stringer tapes T, T' each group of fastener elements E being spaced away from adjacent groups by a blank tape portion B. Top end stops S are secured on the opposed inner edges of the blank tape portions B in positions close to the leading elements E' of the element groups on the respective stringer tapes. Corresponding pairs of groups of elements E are interlocked as shown.

The apparatus according to the invention is illustrated in FIGS. 2 to 7, inclusive, and generally designated at 10 for automatically applying the top end stops S to the fastener chain F as shown in FIG. 1. The apparatus 10 includes a feed roller 11 and a pressure or pinch roller 12 driving therebetween the fastener chain F which has been delivered along a first guide roller 13 past a guide table 14 and along a second guide roller 15. The fastener chain F is delivered intermittently each time for a predetermined distance as in a manner to be hereinafter described.

Designated at 16 is a pressure pad which is held against the stringer tapes T, T' by a compression spring 17 thereby holding the tapes securely on the table 14 while the fastener chain F is being delivered. A feeler finger 18 is disposed underneath the path of travel of the fastener chain F and normally biased to rise from underneath into the path of travel of the chain F. When the spaced blank tape portion B passes over the feeler 18, the feeler 18 projects up between tapes T, T' in the gap at the blank portions B. With a predetermined time lag, the feeler 18 engages with a leading fastener element E' of a succeeding group of fastener elements E (FIG. 5*a*) and the fastener chain F continues to travel a short distance until the feed 11 is stopped, whereupon the feeler 18 is returned by means not shown to its initial position underneath the path of travel of the fastener chain F.

Reference numeral 19 generally designates chain grippers (FIGS. 3 and 4) symmetrically provided one on each side of the path of the chain F. Each gripper 19 comprises an upper arm 20 and a lower arm 21 disposed substantially perpendicular to the path of tape travel and pivotally supported on pin members 22 and 23 extending between the side walls of frame member 24. These arms comprise bifurcated fingers 25 (25') and 26 (26') at the ends extending into the path of the chain F. The fingers 25 (25') and 26 (26') of the upper and lower arms are biased away from each other by a compression spring 27 spaced laterally apart so that the arms 20, 21 may have a grip on the respective tapes T, T' in two places, one place being where the fingers 25 (25') grip the tapes adjacent the leading fastener element E', the other place being where the fingers 26 (26') grip the blank tape portions B.

On each side of the apparatus, at the ends opposite to the fingers 25 (25') and 26 (26'), the upper and lower gripper arms have shoulder portions 28, 29 respectively, which are provided in the inner surface thereof with two successive mutually facing concave recesses 30 and 31 for accommodating a ball member 32. The fingers 25 (25') and 26 (26') may be closed or opened by selectively shifting the ball member 32 between two rest positions defined by the recesses 30 and 31. When the ball 32 is in the outer rest position defined by the outer recesses 31 the fingers 25 and 26 are opened by the action of the spring 27. Shifting of the ball member 32 into the inner rest position defined by recesses 30 causes the fingers 25, 26 to close against the tention of the spring 27.

The frame member 24 supporting the gripper arms at each side of the apparatus has a stud 33 loosely fitted into a bore 34 formed in a plate 35 which is supported on a vertical shaft 36 for oscillating movement thereabout. An oscillating movement is imparted to the plate 35 by a link 37 connected thereto. Mounted on the upper end of the vertical shaft 36 is an oscillating arm 38 of which free end is extended into a cut away portion or indentation 39 of a reciprocating rod member 40 interposed between the upper and lower arms 20, 21 of each tape gripper 19. The reciprocating rod 40 retains therein the ball member 32 and functions to shift the ball 32 between its outer and inner rest positions defined by the recesses 30 and 31 of the gripper arms in response to oscillating movement of the oscillating arm 38.

Figure 3:
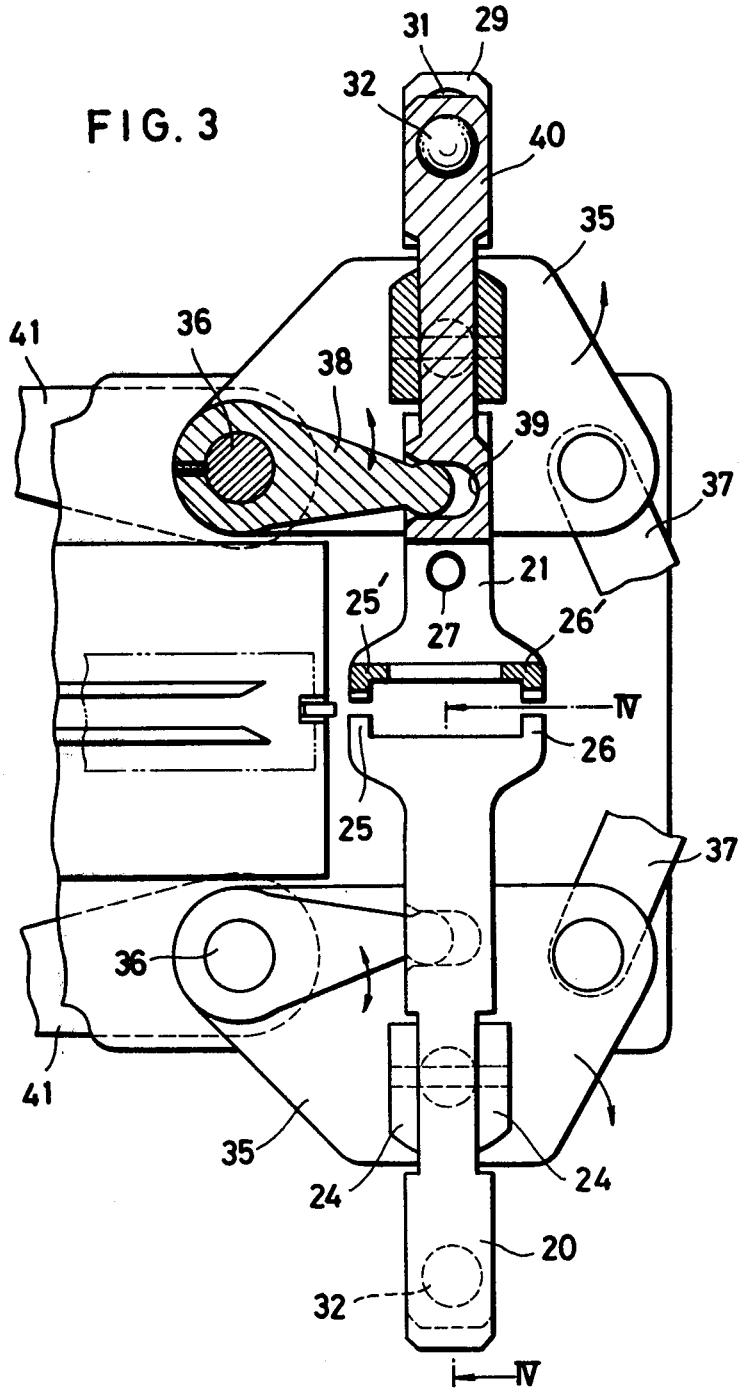
FIG. 3 is a plan view, partly in section, of parts of the apparatus.
Figure 4:
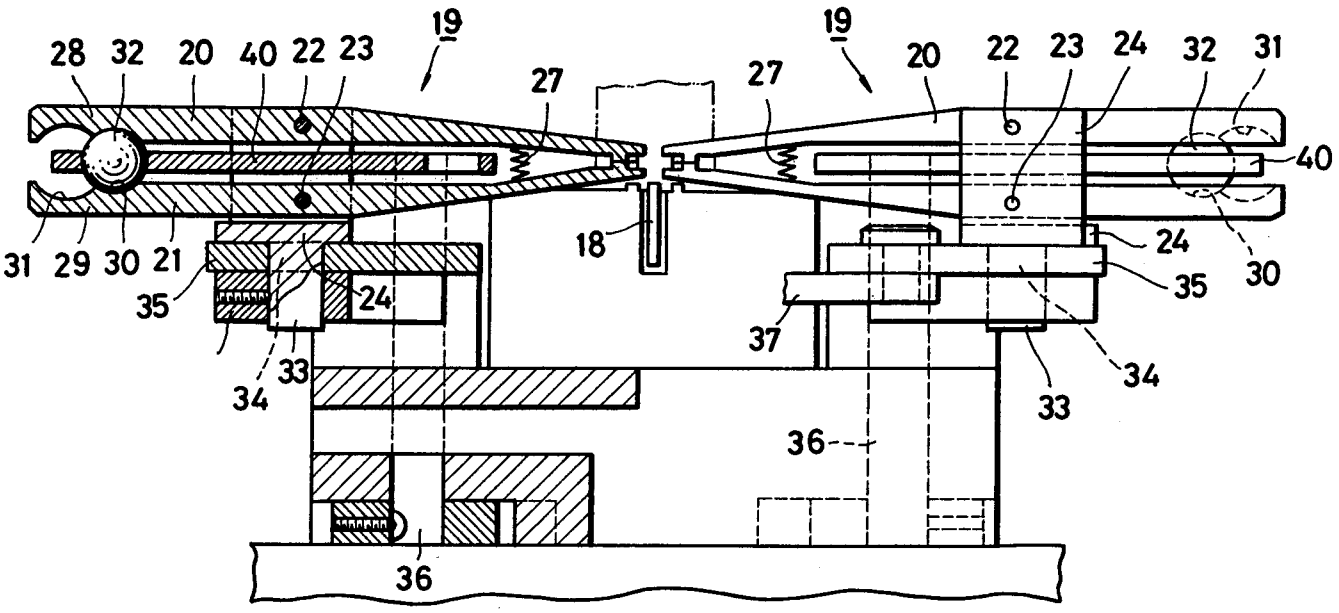
FIG. 4 is a view showing the apparatus of FIG. 3 partially in front elevation and partially in sections taken along the lines IV—IV of FIG. 3.
Figure 5A:
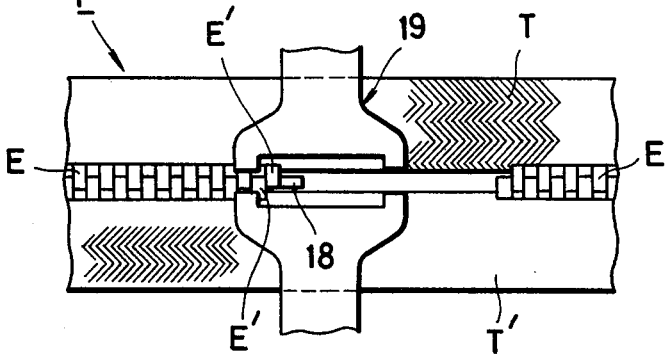
FIGS. 5*a*, 5*b* and 5*c* are plan views schematically illustrating the relative positions of operating parts of the apparatus and the fastener chain.
Figure 5B:
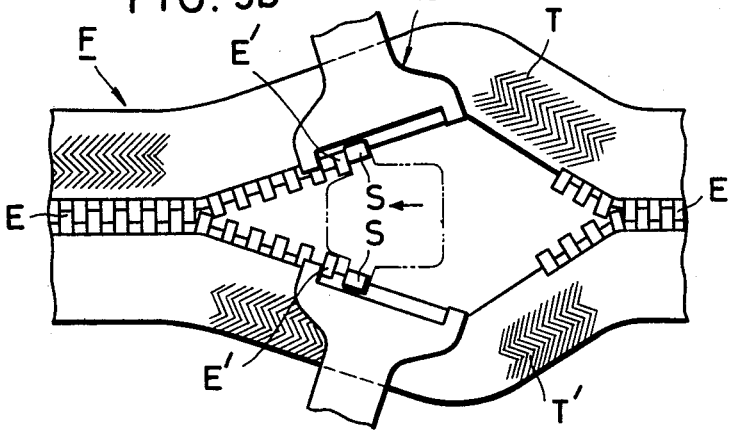

Once the chain F is gripped by the fingers 25 (25') and 26 (26') of each tape gripper 19, the links 37 oscillate each plate 35 about its shaft 36 together with the gripper assembly 42 in the direction indicated by the arrows in FIG. 3 thereby to spread the blank tape portions B symmetrically as shown in FIG. 5*b*. Oscillating movement is selectively imparted to each arm 38 by link 41 through the vertical shaft 36. The arm 38, link 41 and shaft 36 are adapted to follow the oscillating movement of the plate 33 so that unintentional shifting of the ball 32 which might occur during the oscillating movement of the gripper arms is prevented.

Figure 6:
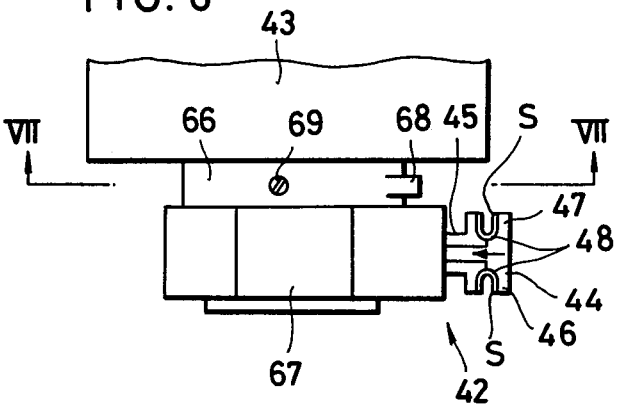
FIG. 6 is a plan view schematically illustrating a top end stop carrier having a transfer nest on each side.
Figure 2:
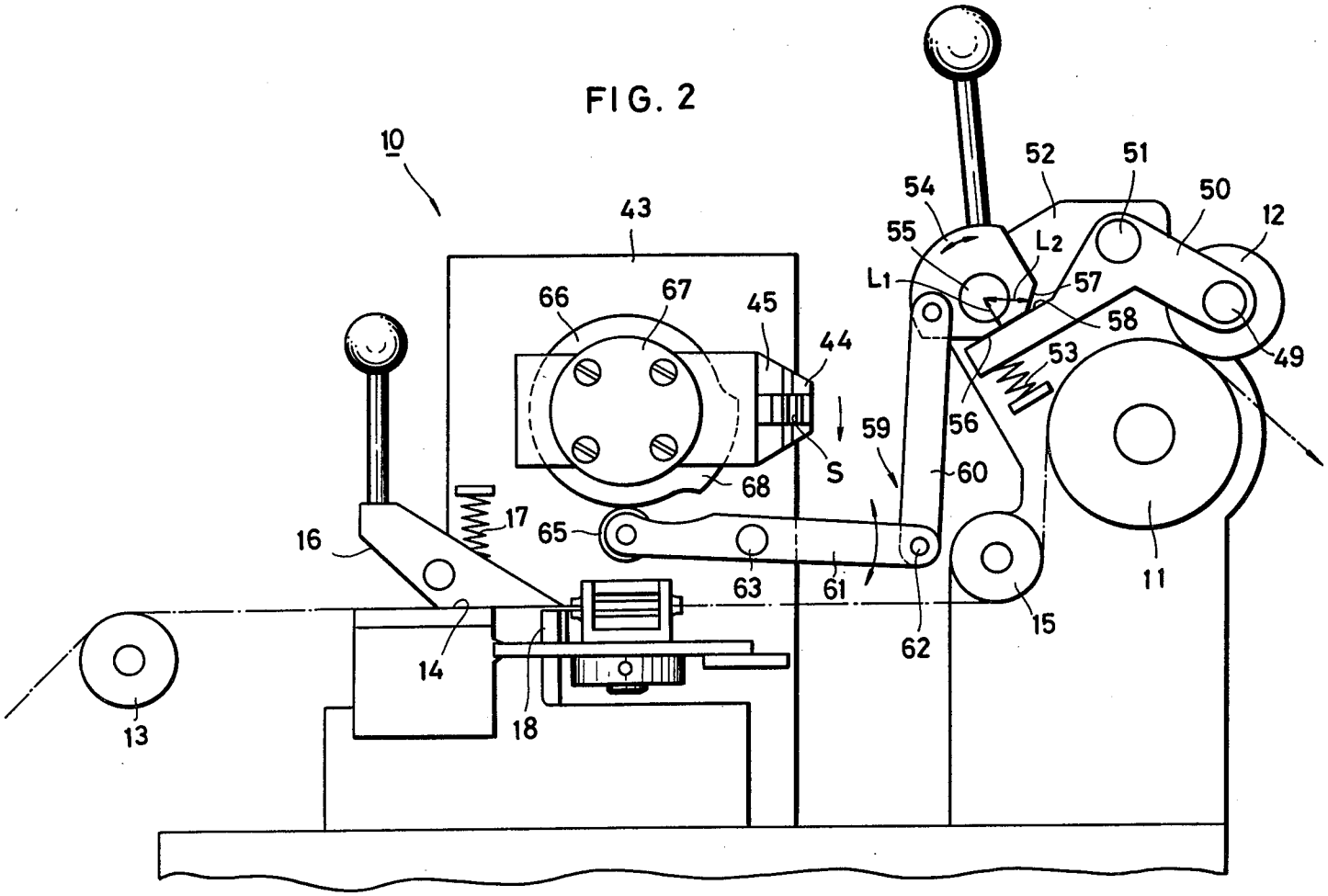
FIG. 2 is a schematic side elevational view of an exemplary apparatus constructed in accordance with the invention.

When the blank tape portions B of the fastener chain F are spread apart, a top end stop carrier generally designated at 42 in FIGS. 2 and 6 swings down into the gap between the spread tapes T, T' for delivering and positioning top end stops S onto the fastener chain F. The top stop carrier 42 is supported on a machine frame 43 overhead the path of chain travel, more specifically overhead the position at which the tapes T,T' are spread, and swings down into the gap between the spread tapes in a plane passing through the center between the spread tapes and in a plane perpendicular to the plane of the fastener chain F. The carrier 42 is provided at its free end with a first slidable block 44 (FIG. 6) and a second slidable block members 45 disposed one on each side of the block 44. The first block 44 has laterally projecting portions 46 and 47 which with the second block members 45 define a top end stop transfer nest 48 on each side of the carrier 42. The transfer nests 48 are arranged such that the top end stops S resiliently held therein may be mounted on the inner edges of the respective tapes T,T' when the carrier 42 is at its lowermost position.

The first and second block members 44, 45 function as a means for clamping the top end stops in position on the fastener chain F. The top end stops S initially U-shaped as shown in FIG. 6 are mounted astride over the inner edges of the spread tapes T, T' and securely clamped thereon as the block member 44 moves in the direction of the arrow as shown in FIG. 6, compressing the top stops S against the block members 45. The top end stops are introduced into the gap between the tapes T, T' in the direction of the arrow as shown in FIG. 5*b* and brought into engagement with the respective tape edges.

Figure 5C:
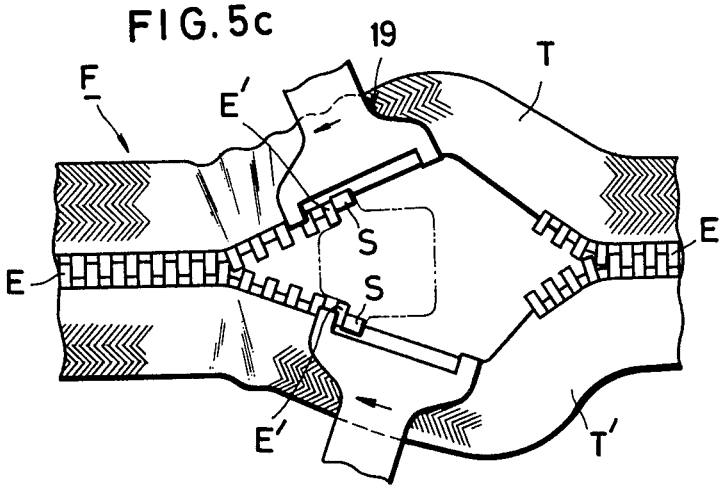

As shown in FIG. 5*a*, the fasteter chain F is fed with the fastener elements E on the opposed tapes T, T' interconnected alternately, with the result that a leading element E' on one tape T is shifted out of registry with the element E' on the other tape T' by a distance corresponding to its width or one element pitch. This positional deviation of the opposed leading elements E' is often greater due to mis-matching of the stringers. FIG. 5*b* illustrates this situation wherein, as the carrier 42 swings down into its lowermost position, one of the U-shaped top stop forming blank metals is held in abutting engagement with one of the leading elements E' on one tape T, while the other blank metal is still spaced away from the corresponding leading element E' on the other tape T'. In order to bring the said other blank metal into engagement with the said corresponding leading element E', the carrier 42 is arranged to make additional movement. To permit this movement, the grippers 19 are also arranged to move slightly in the direction of the arrow as shown in FIG. 5*c* and in the manner disclosed in the aforesaid U.S. patent. The additional movement of the carrier 42 forces the leading elements E' together with the respective U-shaped metals in a direction opposite to the feeding of the fastener chain F, resulting in locally puckered tapes adjacent the grippers 19 as shown in FIG. 5*c*. When this takes place with feed roller 11 and pinch roller 12 inter-engaged, the fastener tapes T, T' are restricted so that the leading elements E', particularly the one which is positioned ahead of the other, receive increased pressure and become displaced or disengaged from the tapes.

Figure 7:
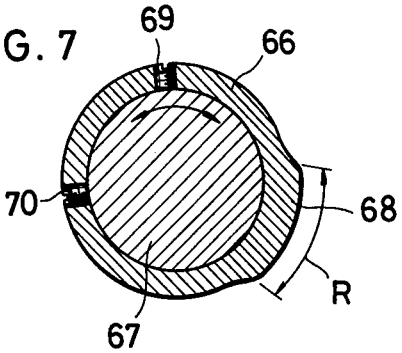
FIG. 7 is a cross sectional view taken along the lines VII—VII of FIG. 7.

The present invention is directed to the provision of means for eliminating the above problems of displacement or detachment of the fastener elements. An exemplary embodiment of such means is illustrated in FIGS. 2, 6 and 7. The pinch roller 12 is rotatably supported on a shaft 49 to which one end of a pivotal arm 50 is connected, as shown in FIG. 2. The arm 50 is pivotal about a pin 51 secured to a machine frame member 52. The other end of the arm 50 is connected to a spring 53 normally biasing the arm 30 clockwise to urge the pinch roller 12 against the feed roller 11. A first cam 54 is pivotally mounted on a pin 55 extending from the frame member 52. The cam 54 has two cam surfaces 56 and 57 alternately engageable with an upper surface 58 of the pivotal arm 50. The distance $L_1$ between the center of the pin 55 and the first cam surface 56 is shorter than the distance $L_2$ between the center of the pin 55 and the second cam surface 57, so that the first cam surface 56 when engaged with the arm 50 serves to keep the pinch roller 12 in contact with the feed roller 11, and the second cam surface 57 when engaged with the arm 50 serves to disengage the pinch roller 12 from the feed roller 11 against the tension of the spring 53 thereby discontinuing the drive of the fastener chain F. The pivotal movement of the cam 50 is effected by a crank mechanism 59 comprising a first crank arm 60 and a second crank arm 61, the two arms 60, 61 being interconnected by a pin 62. The first crank arm 60 is connected to the cam 54, and the second crank arm 61 is pivotally mounted on a pin 63 secured to the frame member 43. At the free end of the second crank arm 61 is provided a roller 65 which is disposed in peripheral engagement with a second or disc cam 66 mounted on a rotary shaft 67. The disc cam 66 has a peripherally projecting cam surface 68 defining an effective range R of camming action timed with the operation of the carrier 42. This range corresponds to the angle of rotation that the carrier 42 makes from the time point of entering into the gap in the opposed fastener tapes T, T' which have been spread apart, up to the time point of completing the clamping of the top end stops S onto the fastener chain F. The disc cam 66 is mounted on the rotary shaft 67 with its phase adjusted so as to ensure engagement of the operating cam surface 68 with the roller 65 in correspondence with the angle of rotation of the carrier 42. The phase of the disc cam 66 can be adjusted by changing the positions of set screws 69, 70 securing the cam 66 to the rotary shaft 67, whereby the timing of camming action upon the roller 65 can be adjusted as desired. Engaging the operating cam surface 68 with the roller 65 rotates the second crank arm 61 counterclockwise so that the first crank arm 60 moves the first cam 54 clockwise to bring the second cam surface 57 into contact with the pivotal arm 50 thereby disengaging the pinch roller 13 from the feed roller 11. Disengaging the operating cam surface 68 from the roller 65 rotates the second crank arm 61 clockwise which in turn moves the cam 54 counterclockwise to take the first cam surface 56 into engagement with the arm 50 so that the pinch roller 12 is brought back into operating engagement with the feed roller 11.

The effective range of camming action of the second disc cam 66 substantially corresponds to the angle of rotation of the carrier 42 at least beginning with the position of the carrier 42 immediately before engaging the leading elements E' and ending with the position in which the carrier 42 has completed the clamping of top end stops S onto the fastener chain F. Stated otherwise, the time required to take the operating cam surface 68 into and out of engagement with the roller 65 substantially corresponds to the time consumed from immediately before the carrier 42 reaches the leading fastener elements E' until the top end stops S are completely clamped in place on the fastener chain F.

Although various minor modifications may be suggested by those versed in the art, it should be understood that I wish to embody within the scope of the patent warranted hereon, all such embodiments as reasonably and properly come within the scope of my contribution to the art.

I claim:

1. Apparatus for automatically applying top end stops on a fastener chain moving unidirectionally along a path of travel and having a pair of continuous stringer tapes provided along opposed inner edges thereof with groups of fastener elements and provided with blank tape portions between the groups of elements, each group of fastener elements being interlocked with and having a leading element shifted out of registry with a leading element of a corresponding group on the opposite tape, comprising in combination: a fastener chain drive operable to drive the fastener chain unidirectionally along said path and comprising a feed roller and a pinch roller normally urged into engagement with said feed roller; means for stopping corresponding pairs of blank tape portions at a predetermined position in said path of travel; a pair of tape grippers provided in said position one on each side of said path of tape travel, each gripper being adapted to grip the respective stringer tape and to spread said tapes apart along a limited region; a top stop carrier mounted above said predetermined position for arcuate movement into and out of said path in the region where the tapes are spread by said tape grippers for delivering and clamping top end stops onto the fastener chain; and means responsive to said arcuate movement of said top stop carrier in timed relation therewith for bringing said pinch roller into and out of engagement with said feed roller so as to allow said opposite leading elements to be brought closely adjacent to said top end stops being delivered by said top end stop carrier while said fastener chain is released from said fastener chain drive.

2. Apparatus as defined in claim 1 wherein said roller engagement means comprises:

(a) a pivotal arm connected at one end to said pinch roller, (b) a first cam having two cam surfaces alternately engageable with the other end of said pivotal arm, (c) a second cam cooperative with said top stop carrier and having a projecting cam surface that shifts said first cam between said two cam surfaces, and (d) a linkage operatively connecting said first cam to said second cam for transmitting the motion of said second cam to said first cam, whereby said pinch roller is brought into and out of engagement with said feed roller in response to said arcuate movement of said top stop carrier.

3. Apparatus as defined in claim 2 wherein said projecting cam surface of said second cam has an effective range of camming action substantially corresponding to the angle of rotation of said carrier at least beggining with the position of said carrier immediately before engaging said leading elements and ending with the position in which said carrier has completed the clamping of top end stops onto the fastener chain.

4. Apparatus as defined in claim 2 wherein one of said two cam surfaces of said first cam is spaced from a pivot of said cam by a distance shorter than is the other.

* * * * *